US007934614B2

(12) United States Patent
Finneran

(10) Patent No.: US 7,934,614 B2
(45) Date of Patent: May 3, 2011

(54) TWO-PIECE SEAL VIAL ASSEMBLY

(75) Inventor: James G. Finneran, Vineland, NJ (US)

(73) Assignee: J. G. Finneran Associates, Inc., Vineland, NJ (US)

( * ) Notice: Subject to any disclaimer, the term of this patent is extended or adjusted under 35 U.S.C. 154(b) by 1240 days.

(21) Appl. No.: 11/448,930

(22) Filed: Jun. 7, 2006

(65) Prior Publication Data

US 2007/0284330 A1 Dec. 13, 2007

(51) Int. Cl.
*B65D 45/16* (2006.01)

(52) U.S. Cl. ..... 215/294; 215/363; 215/355

(58) Field of Classification Search ..... 215/43, 215/247, 297, 294, 363, 277, 355; 604/415
See application file for complete search history.

(56) References Cited

U.S. PATENT DOCUMENTS

| | | | | | |
|---|---|---|---|---|---|
| 701,101 | A | * | 5/1902 | Stutz | 215/355 |
| 2,010,257 | A | * | 8/1935 | Fehse | 29/557 |
| 2,876,775 | A | * | 3/1959 | Barr, Sr. et al. | 600/577 |
| 3,136,440 | A | * | 6/1964 | Krug et al. | 215/247 |
| 3,330,281 | A | * | 7/1967 | Visser | 604/90 |
| 3,362,556 | A | * | 1/1968 | Waldrum | 215/321 |
| 3,405,832 | A | * | 10/1968 | Lukesch et al. | 215/355 |
| 3,900,122 | A | * | 8/1975 | Dichter | 215/43 |
| 4,121,727 | A | * | 10/1978 | Robbins et al. | 215/211 |
| 4,669,771 | A | | 6/1987 | Finneran | |
| 4,872,572 | A | * | 10/1989 | Schrooten | 215/307 |
| 4,893,636 | A | * | 1/1990 | Cook et al. | 600/577 |
| 4,915,243 | A | * | 4/1990 | Tatsumi et al. | 215/247 |
| 4,991,104 | A | * | 2/1991 | Miller | 700/197 |
| 5,016,771 | A | | 5/1991 | Finneran | |
| 5,108,386 | A | * | 4/1992 | Finneran | 604/403 |
| 5,114,030 | A | * | 5/1992 | Conard | 215/249 |

(Continued)

FOREIGN PATENT DOCUMENTS

DE 195 32 980 A1 3/1997

(Continued)

OTHER PUBLICATIONS

Printed material from www.whatman.com: Leadership in separations technology for the life sciences—Syringless filters (8 pgs); © 2006 Whatman plc.

*Primary Examiner* — Anthony Stashick
*Assistant Examiner* — Christopher B McKinley
(74) *Attorney, Agent, or Firm* — Stradley Ronon Stevens & Young, LLP

(57) ABSTRACT

A two-piece seal vial assembly. The first piece is a vial defining an aperture adapted to contain a liquid. The vial has a base, a crown disposed opposite the base, and an upright side wall extending from the base to the crown and including a tapered inner diameter and a flange located proximate the crown. The second piece is a seal top defining an opening that runs through the length of the seal top. The seal top has a top portion providing a neck finish and, when the seal top and the vial are assembled, a snap groove releasably receiving the flange of the vial and a tapered portion that frictionally engages the tapered inner diameter of the vial. Although not one of the two main components of the assembly, a cap may be included to releasably engage the neck finish of the seal top to close the seal top.

15 Claims, 8 Drawing Sheets

U.S. PATENT DOCUMENTS

| | | | | |
|---|---|---|---|---|
| 5,232,109 | A * | 8/1993 | Tirrell et al. | 215/247 |
| 5,297,561 | A * | 3/1994 | Hulon | 600/577 |
| 5,379,907 | A * | 1/1995 | Niedospial et al. | 215/247 |
| 5,433,330 | A * | 7/1995 | Yatsko et al. | 215/247 |
| 5,662,230 | A * | 9/1997 | Finneran | 215/252 |
| 5,732,837 | A * | 3/1998 | Jones | 215/311 |
| 5,772,057 | A * | 6/1998 | Finneran | 215/252 |
| 5,857,579 | A * | 1/1999 | Finneran | 215/252 |
| 5,868,264 | A * | 2/1999 | Fulford et al. | 215/232 |
| 6,193,064 | B1 | 2/2001 | Finneran | |
| 7,037,580 | B2 | 5/2006 | Razavi et al. | |
| 7,063,221 | B2 * | 6/2006 | Garcia-Cuenca et al. | 215/355 |
| 2002/0003122 | A1 * | 1/2002 | Sudo | 215/247 |
| 2002/0023893 | A1 * | 2/2002 | Sudo et al. | 215/355 |
| 2002/0079285 | A1 * | 6/2002 | Jansen et al. | 215/249 |
| 2003/0121878 | A1 * | 7/2003 | Finneran | 215/247 |
| 2005/0167390 | A1 * | 8/2005 | Dubs et al. | 215/274 |

FOREIGN PATENT DOCUMENTS

| | | |
|---|---|---|
| EP | 0 509 281 A2 | 10/1992 |

* cited by examiner

TWO-PIECE SEAL VIAL ASSEMBLY

TECHNICAL FIELD

The present invention relates generally to vials and, more particularly, to the seal assembly of vials used in the analytical chemistry and pharmaceutical markets.

BACKGROUND OF THE INVENTION

Many types of dispensers require a securely sealed cap. This requirement is especially true for vials, particularly laboratory sample vials and dispensers for injectable pharmaceuticals and medicinal agents. The required seal is presently accomplished with a standard snap cap, a crimp aluminum cap, or a threaded cap and a corresponding bottle neck finish.

Many conventional vials have a standard snap cap and neck finish; most aspirin bottles utilize this type of container. In this basic snap cap design, the extended skirt of the cap secures under a protrusion on the neck of the vial such that there is one point of contact between the skirt and vial upon sealing the vial. In addition, those designs which have more than one point of contact do not generally have tight dimensional tolerances between the cap and vial contact points. This type of cap can only be used on vials that have a snap ring for engagement with the skirt of the snap cap.

Another common closure for vials of this type is a crimp cap, which is securely retained on the neck finish of the container by crimping a metallic (usually aluminum) skirt under a lip on the neck of the vial. One advantage of the aluminum crimp cap is that it works on vials having either a standard crimp seal or a snap ring. A disadvantage is that the aluminum crimp cap requires the use of a crimping tool to form a seal. The seal is subject to the amount of squeeze and alignment given by the user. When properly applied, however, the aluminum crimp cap provides a good seal against solvent evaporation.

The crimping tool is made of metal (typically aluminum) to provide the force necessary to deform the aluminum crimp cap and, thereby, either to apply or remove the aluminum crimp cap to or from the vial. Removal of an aluminum crimp cap from a vial is dangerous. If not done properly, the neck finish of the vial can break—leaving ragged glass edges. Moreover, sharp aluminum pieces are exposed as the aluminum crimp cap is literally torn away from the vial.

Still another common closure for vials involves a standard screw thread neck finish on the vial and a corresponding screw thread on the cap. Closure is attained and a seal obtained by twisting or rotating the cap onto the vial. Thus, screw thread closures require finger torque pressure to apply and remove the cap. The seal is subject to the amount of torque applied by the user. When torqued properly, the threaded cap provides a good seal equivalent to or better than the aluminum crimp seal. One drawback is that the threaded cap can lose torque upon relaxation of the plastic material, from which the typical threaded cap is made, which allows the cap to back off the threads. In addition, the threaded cap can only be used on threaded vials.

Improvements to the various caps and closures have been made. The inventor of the present application, James G. Finneran, has patented three such improvements. See U.S. Pat. No. 5,662,230; U.S. Pat. No. 5,772,057; and U.S. Pat. No. 5,857,579—each titled "Crimp Top Seal for Vials." The improvements generally combine the better properties of the snap cap and the crimp aluminum cap to provide a more safe and secure crimp top seal. These three patents are incorporated into this document by reference.

Regardless of the type of cap used to seal the vial, a need exists to provide easy, quick, and repeatable access to the contents of the sealed vial. This need often means designing the vial assembly to avoid having to remove the cap to access the contents of the vial, a need met by existing devices in a number of ways. One way is taught by U.S. Pat. No. 6,193,064 titled "Cap Closure and Liner" and issued to the inventor of the present application, James G. Finneran. The invention relates to caps for bottles, vials, or other containers and especially to caps for laboratory sample bottles and dispensers containing pharmaceuticals and medicinal agents, which include a penetrable segment for introduction or withdrawal of material from a container on which the cap is mounted. This type of container requires a securely sealed cap which allows quick and easy access to the container contents.

The invention taught in the '064 patent is a cap closure including a top member with a center opening, a dependent skirt, and a liner with a central raised portion which fits into the center opening of the top member. The side walls of the center opening and the liner raised portion are adapted to mate with one another, so that the central raised portion of the liner is retained in the center opening of the top member by an interference fit, thus holding the liner under the top member. The central raised portion may also be concave. The height of the liner raised portion should be no greater than that of the central opening in the cap to minimize contamination and to provide a combination which is relatively easy to assemble but is nevertheless secure from inadvertent mechanical dislodgement of the assembled components.

The liner concept has also been applied in the context of vial trays. Analytical chemistry laboratories use a variety of different sized and shaped vials for different types of experimental assays, including sorbent assays, high-throughput screening assays, and combinatorial chemistry analysis. In those assays, there is a need to provide support for the vials used. Often, the support is necessary to maintain the vials in an upright position to facilitate chemical reactions, prevent assay fluids from escaping from the vials, enable movement of the vials without disturbing the assay, or meet other experimental considerations. Various vial-holding devices, such as microplates or trays, have been used for assays performed in these laboratories, optionally used in autosamplers. Generally, these devices contain multiple compartments for inserting and providing support for vials. U.S. Pat. No. 6,193,064 titled "Multi-Tier Vial Plate" and issued to the inventor of the present application, James G. Finneran, teaches an exemplary vial plate for holding vials.

A component related to the vial tray is a liner as disclosed in U.S. Pat. No. 7,037,580 titled "Pattern Adhesive Sealing Films and Mats for Multi-Well Plates" and issued to the inventor of the present application, James G. Finneran. The disclosed component is a thin (about 2 mils thick) adhesive liner placed over a tray to seal around vials stored in holes (typically 96 of them) in the tray. The adhesive is present on all portions of the liner except in the area of the vials themselves. Therefore, needles can penetrate the liner and enter the vials without contacting adhesive. A vial is disposed under each oval or circular, non-adhesive area on the surface of the liner. Although other materials are suitable, the liner is typically made of polytetrafluoroethylene (PTFE) such as Teflon (a trademark of E.I. du Pont de Nemours & Co., Inc. of Wilmington, Del.). PTFE is "A highly stable thermoplastic tetrafluoroethylene homopolymer composed of at least 20,000 $C_2F_4$ monomer units linked into very long unbranched chains." Merck Index at 7560.

Finally, Whatman plc of the United Kingdom, a leading supplier of separations technology to the life sciences industry, offers noteworthy products on its website (www.whatman.com). Whatman filters are used for research, analysis, and quality control in the pharmaceutical, biotechnology, and environmental testing industries. One particular Whatman product is the UniPrep™ syringeless filter, a preassembled filtration device for the filtration and storage of laboratory samples. This device is quick and easy to use and features a plunger, filter, and vial in one unit. The device replaces syringe-coupled filtration devices with single, disposable units. UniPrep™ devices consist of two parts: a test tube and a filter-plunger. The design incorporates a pre-filter and a membrane into the tip of the plunger. When the filter-plunger is pressed through the liquid placed in the test tube, positive pressure forces the filtrate up into the reservoir of the filter-plunger.

The Whatman Mini-UniPrep™ syringeless filters, with durable plastic caps, provide a faster, easier way to remove particulates from samples being prepared for high performance liquid chromatography (HPLC) analysis. The device allows the user to prepare samples in less than the time required by other methods. The Mini-UniPrep™ is a pre-assembled filtration device consisting of a 0.5 ml capacity chamber and a plunger. The plunger contains a filtration membrane at one end and a pre-attached cap and septum at the other end. The plunger is pressed through the sample in the outer chamber and positive pressure forces the filtrate into the reservoir of the plunger. Air escapes through the vent hole until a locking ring is engaged, providing an air-tight seal. Then the Mini-Uniprep™ device can be placed into any approved autosampler.

To overcome the shortcomings of conventional devices such as those described above, a new seal vial assembly is provided. An object of the present invention is to provide an improved assembly that allows easy, quick, and repeatable access to the contents of the sealed vial. A related object is to provide a vial assembly that avoids having to remove the cap to access the contents of the vial.

Another object is to provide an assembly having two, main, self-aligning components that form a liquid-tight seal. Yet another object of the invention is to provide an assembly with a redundant seal, by which two, separate mechanisms can each individually provide the seal. A related object is to provide a seal that is consistent and minimizes liquid (e.g., solvent) evaporation. It is still another object of the present invention to provide a seal able to assure long-term storage of liquids without leakage. An additional object is to provide a seal vial assembly with dimensional control allowing tolerance variation during use.

BRIEF SUMMARY OF THE INVENTION

To achieve these and other objects, and in view of its purposes, the present invention provides a two-piece seal vial assembly. The first piece, or component, is a vial defining a center aperture adapted to contain a liquid. The vial has a base, a crown disposed opposite the base, and an upright side wall extending from the base to the crown. The side wall has a tapered inner diameter and a flange located proximate the crown.

The second piece, or component, is a seal top defining a center opening that runs through the length of the seal top. The seal top has a top portion providing a neck finish, a snap groove releasably receiving the flange of the vial when the seal top and the vial are fully assembled, and a tapered portion that frictionally engages the tapered inner diameter of the vial when the seal top and the vial are assembled. Although not one of the two main components of the assembly, a cap may be included. The cap releasably engages the neck finish of the seal top to close the seal top.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
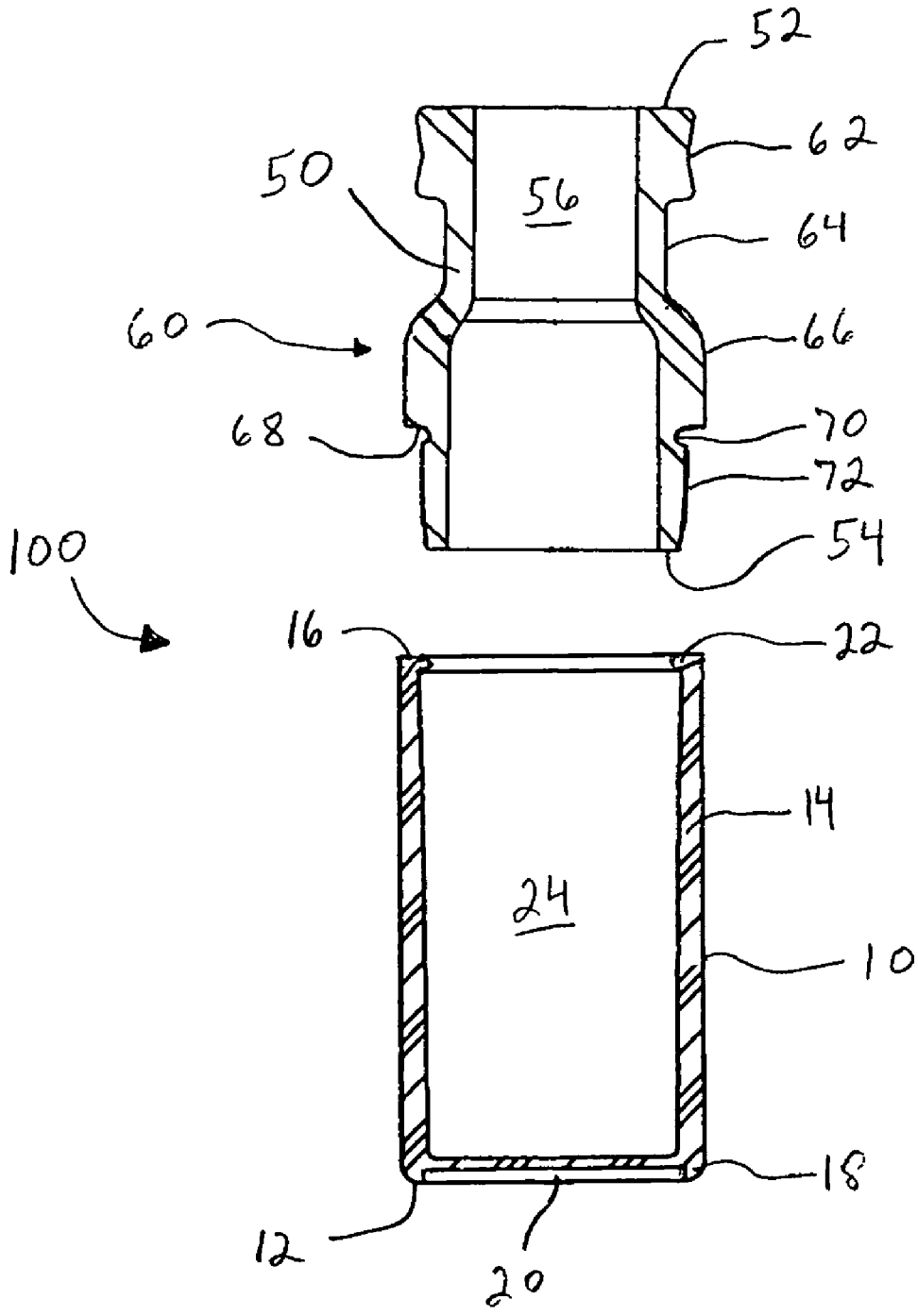
FIG. 1 is a cross-sectional view of a two piece seal vial assembly, according to an embodiment of the present invention, with the two components in an unassembled state.
Figure 2:
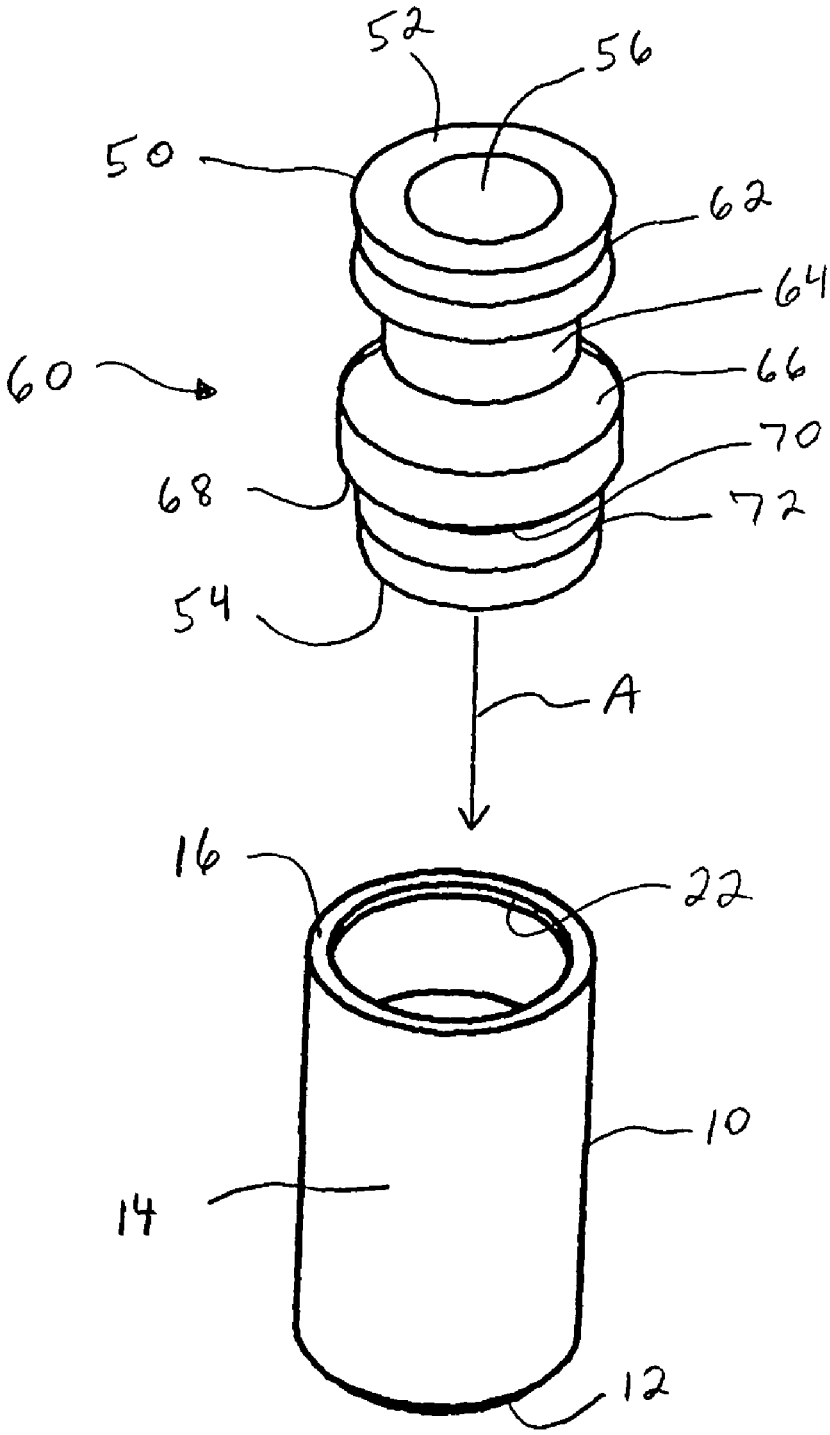
FIG. 2 is an isometric view of the assembly shown in FIG. 1.

Referring now to the drawing, in which like reference numbers refer to like elements throughout the various figures that comprise the drawing, FIG. 1 shows a cross-sectional view of a two piece seal vial assembly 100, according to an embodiment of the present invention, with the two components in an unassembled state. FIG. 2 is an isometric view of the assembly shown in FIG. 1. FIGS. 1 and 2 illustrate the two main components: a vial 10 and a seal top 50.

Generally, vials used in analytical chemistry assays are made of glass or plastic, among other suitable materials. Such materials include polypropylene, PTFE, polyethersulfone, polyvinylidene fluoride, and nylon. Nylon is a term coined by its inventors at E.I. duPont de Nemours & Co., Inc. Not a trademark, the term designates any of a family of high-strength, resilient, synthetic materials whose long-chain molecule contains the recurring amide group CONH. The official chemical name for nylon is polyhexamethyleneadipamide, referred to as polymide. Although all of these materials are suitable for the vial 10 and a seal top 50, the preferred material used to make the vial 10 and seal top 50 is polypropylene. This is advantageous because metal is undesirable in laboratory settings.

Turning now to details of the vial 10 and the seal top 50 that form the assembly 100, the seal top 50 illustrated in FIGS. 1 and 2 has only one of many suitable configurations. Variations in the configuration of the seal top 50 are defined by, among other application-specific parameters, the type of cap that will be used to close the assembly 100. As discussed below, a number of different caps can be used to close the seal top 50. Typically, the cap is preassembled (i.e., before the components reach the user) by machinery during the process of manufacturing the seal top 50 and its cap.

The seal top 50 has a center opening 56 that runs through the length of the seal top 50 from its top 52 to its bottom 54, rending the component hollow. A seal top skirt 60 extends vertically (axially) downward from the top 52 to the bottom 54 of the seal top 50. The skirt 60 essentially has five main portions. The top portion 62 of the skirt 60 begins at the top 52 and extends downward from the top 52. The top portion 62 provides the neck finish necessary to mate with the particular cap that will be used to close the seal top 50. The particular finish shown in FIG. 1 mates with a crimp cap.

The top portion 62 ends in a substantially flat (i.e., vertical) transition portion 64 of the skirt 60. In turn, the transition portion 64 ends in a shoulder 66 (the third portion of the skirt 60) which has an undercut 68. Just below the undercut 68 of the shoulder 66, the skirt 60 has a snap groove 70 as its fourth portion. The snap groove 70 encircles the skirt 60 and is positioned so as to align with a flange 22 on the vial 10 when the seal top 50 and the vial 10 are assembled. Finally, the lowest portion of the skirt 60 is a tapered portion 72.

The vial 10 is substantially cylindrical in shape, having a base 12 and an upright side wall 14 extending from the base 12 to a crown 16. The base 12 and side wall 14 define a center aperture 24. Although the base 12 may be completely flat, it also may be provided with a rim 18 defining a seat 20 as shown in FIG. 1. The seat 20 can engage a separate projection supporting the vial 10, such as a bump in a carrying tray. The side wall 14 has an inner diameter that is tapered to frictionally engage the corresponding tapered portion 72 of the seal top 50 when the seal top 50 and the vial 10 are assembled. The taper of the side wall 14 of the vial 10 is in the same direction as the taper of the tapered portion 72 of the seal top 50, creating an interference fit. The corresponding tapers allow the assembly 100 to be self-aligning and provide secure assembly of the seal top 50 in the vial 10, helping to seal any liquid contained in the vial 10.

Near the crown 16 of the vial 10 is a flange 22. The flange 22, which is part of the inner circumference of the side wall 14, encircles the inner diameter of the vial 10. The flange 22 is positioned to engage the groove 70 of the seal top 50 when the seal top 50 and the vial 10 are assembled.

To assemble the seal top 50 and the vial 10 of the assembly 100, the user grasps the two components in the relative positions shown in FIGS. 1 and 2. Typically, assembly will be accomplished while the vial 10 is filled with liquid and the seal top 50 is closed by its cap. The user moves the seal top 50 toward the vial 10 in the direction of arrow A as shown in FIG. 2. Once the bottom 54 of the seal top 50 just engages the aperture 24 of the vial 10, the tapered portion 72 of the seal top 50 facilitates axial alignment between the seal top 50 and the vial 10. The user continues to push the seal top 50 into engagement with the vial 10. As the user does so, the frictional force between the tapered portion 72 of the seal top 50 and the tapered side wall 14 of the vial 10 increases. This frictional engagement helps to form a liquid-tight seal between the seal top 50 and the vial 10.

Eventually, as the user continues to push the seal top 50 into engagement with the vial 10, the flange 22 of the vial 10 snaps into the groove 70 of the seal top 50. Advantageously, a snap is heard and felt when the flange 22 engages the groove 70 and the top seal 50 and vial 10 are fully assembled. No tools are required either to apply or to remove the seal top 50. The snap engagement further helps to form a liquid-tight seal between the seal top 50 and the vial 10. The snap groove 70 provides a pull down and lock mechanism in conjunction with the flange 22 which helps to seal the vial 10.

Thus, the liquid-tight seal is accomplished by the combination of the snap engagement and tapered frictional engagement. Although either mechanism alone suffices to provide an adequate seal in at least some applications, the combination provides a redundant seal adequate for most applications. Clearly, the resiliency of the material used to form the seal top 50 and the vial 10 allows the components to frictionally slide against one another and to snap into and out of locking engagement. Although the same resilient material can be used to form both the vial 10 and the seal top 50, different resilient materials could be used to construct the two components. Because the seal top 50 and vial 10 are made of a plastic like polypropylene, their seal is consistent and minimizes liquid (e.g., solvent) evaporation. Use of a relatively rigid material like polypropylene to form the vial 10 and the seal top 50 provides a seal able to provide for long-term storage without leakage.

To disassemble the seal top 50 from the vial 10, the user pulls upward on the seal top 50, while holding the vial 10, with sufficient force to allow the flange 22 of the vial 10 to flex out of or expand past the groove 70 of the seal top 50. A continued pulling force overcomes the frictional force between the tapered portion 72 of the seal top 50 and the tapered side wall 14 of the vial 10 until the seal top 50 completely exits the aperture 24 of the vial 10. At that point, the two components are again disassembled (i.e., they assume the position shown in FIGS. 1 and 2). Thus, the user gains easy, quick, and repeatable access to the contents of the sealed vial without having to remove the cap to access the contents of the vial or to insert a syringe through the cap.

The snap groove 70 has a substantially semi-circular cross-section (with some latitude allowed for tolerance variation) to accept the correspondingly curved flange 22 of the vial 10 while allowing tolerance variation upon downward movement of the seal top 50 onto the vial 10. The groove 70 and flange 22 are positioned on their respective components so that they fully engage, during assembly of the seal top 50 and the vial 10, just before or just as the crown 16 of the vial 10 contacts the undercut 68 of the seal top 50.

The following examples are included to more clearly demonstrate the overall nature of the invention. These examples are exemplary, not restrictive, of the invention. FIGS. 3A, 3B, 4, 4A, and 4B provide suitable dimensions for an assembly 100 including a vial sized to hold 1.5 milliliters of liquid. The example dimensions are provided in inches and degrees. The dimensional tolerances of the various elements of the vial 10 and seal top 50 are all tightly controlled, preferably to plus or minus 5-10 thousandths of an inch, most preferably 3-7 thousandths of an inch.

Figure 3A:
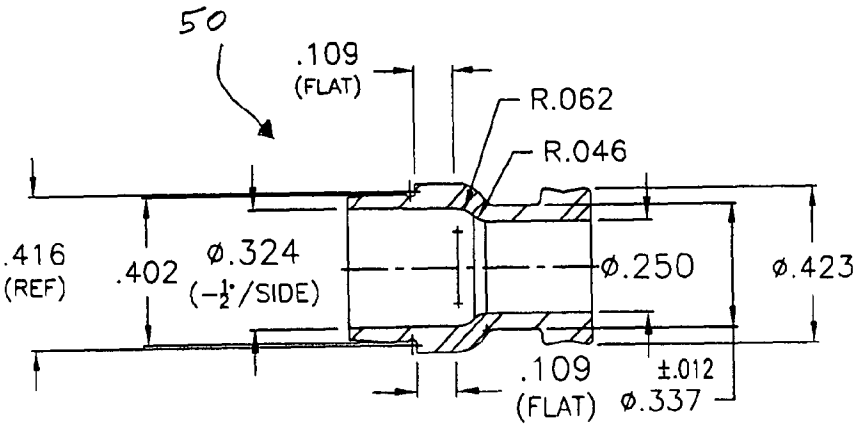
FIG. 3A is a cross-sectional view of the seal top component of an exemplary embodiment of the present invention, illustrating suitable dimensions for that component.
Figure 3B:
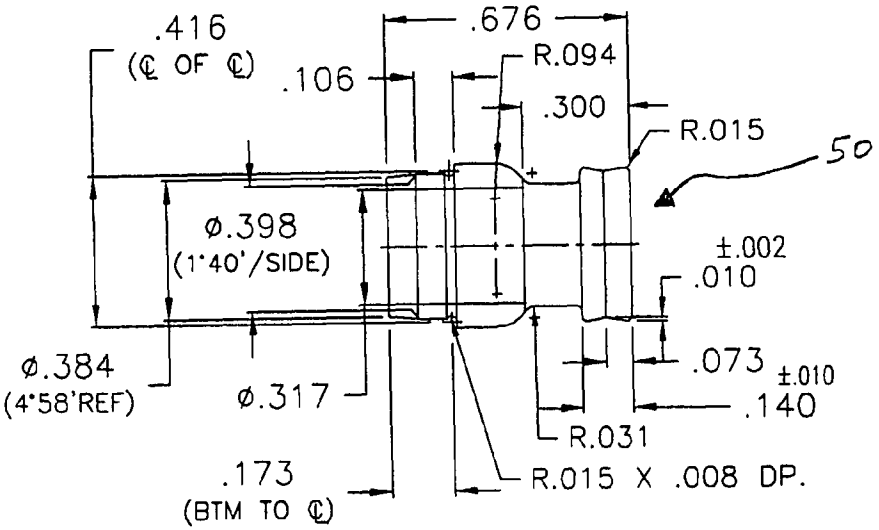
FIG. 3B is a side view of the seal top component shown in FIG. 3A, illustrating suitable dimensions for that component.
Figure 4A:
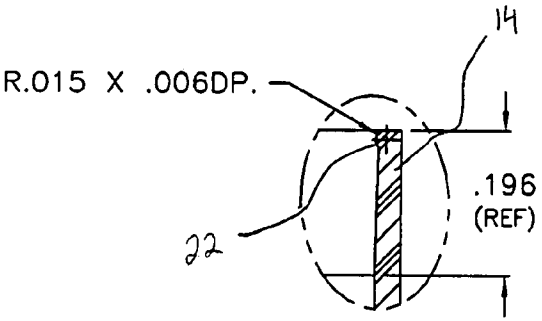
FIG. 4A is a cross-sectional view of the highlighted portion of the vial component labeled 4A in FIG. 4, illustrating suitable dimensions for that portion of the component.
Figure 4B:
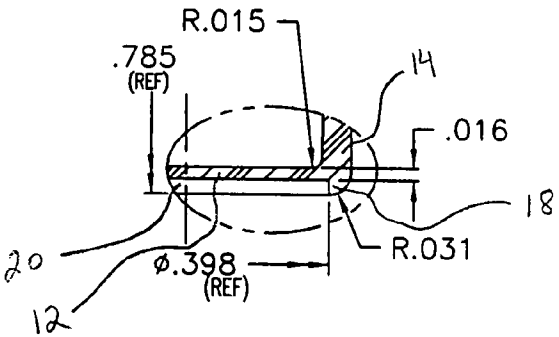
FIG. 4B is a cross-sectional view of the highlighted portion of the vial component labeled 4B in FIG. 4, illustrating suitable dimensions for that portion of the component.
Figure 4:
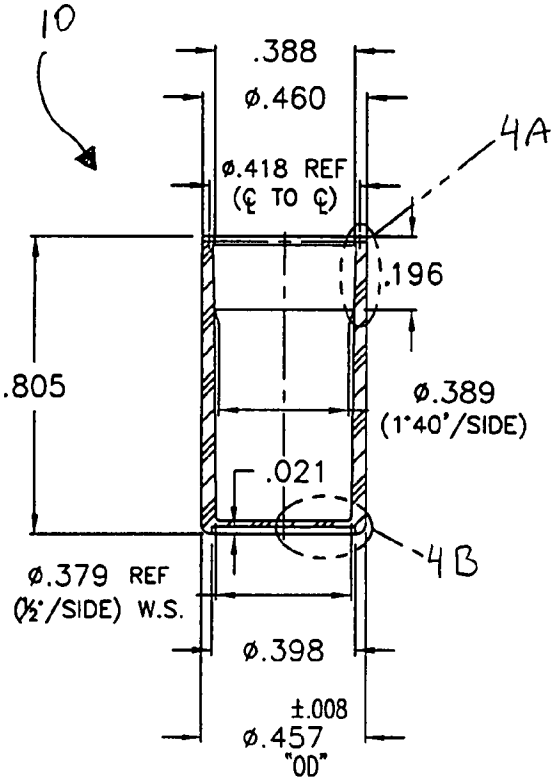
FIG. 4 is a cross-sectional view of the vial component of an exemplary embodiment of the present invention, illustrating suitable dimensions for that component.

More specifically, FIG. 3A is a cross-sectional view of the seal top 50 of an exemplary embodiment of the present invention, illustrating suitable dimensions for that component. FIG. 3B is a side view of the seal top 50 shown in FIG. 3A. FIG. 4 is a cross-sectional view of the vial 10 of the exemplary embodiment, illustrating suitable dimensions for that component. FIG. 4A is a cross-sectional view of the highlighted portion of the vial 10 labeled 4A in FIG. 4, illustrating suitable dimensions for the flange 22 of the side wall 14 of the vial 10. FIG. 4B is a cross-sectional view of the highlighted portion of the vial 10 labeled 4B in FIG. 4, illustrating suitable dimensions for the base 12, rim 18, and seat 20 of the vial 10.

In most applications, it is desirable to close the center opening 56 of the seal top 50. Such closure can be accomplished using a variety of caps, three of which are discussed below. The cap is typically made from a resilient material such as plastic. Again, this is advantageous because metal is undesirable in laboratory settings. The caps, the vial 10, and the seal top 50 can be colored or labeled to provide identifying information. The vial 10 and the seal top 50 are preferably clear or at least translucent, however, to allow easy visual inspection.

1. Crimp Cap

Figure 5C:
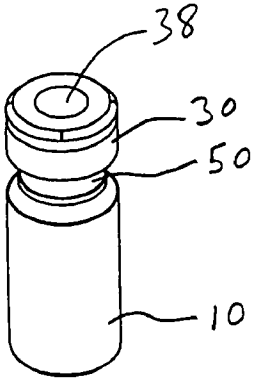
FIG. 5C is an isometric view of the assembly shown in FIG. 5B.
Figure 5B:
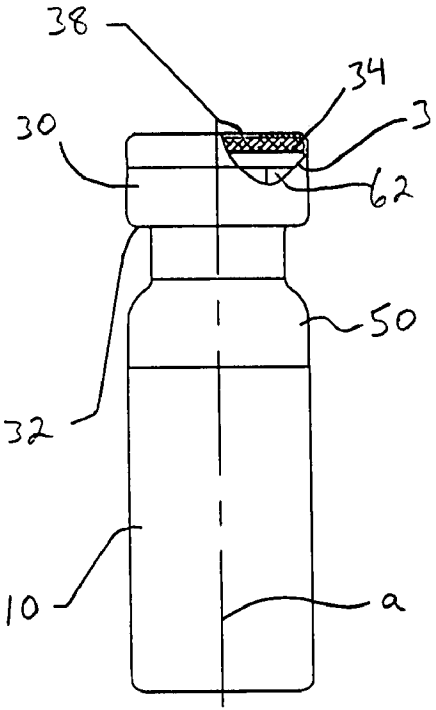
FIG. 5B is a side view of the assembly shown in FIG. 5A with the components in an assembled state.
Figure 5A:
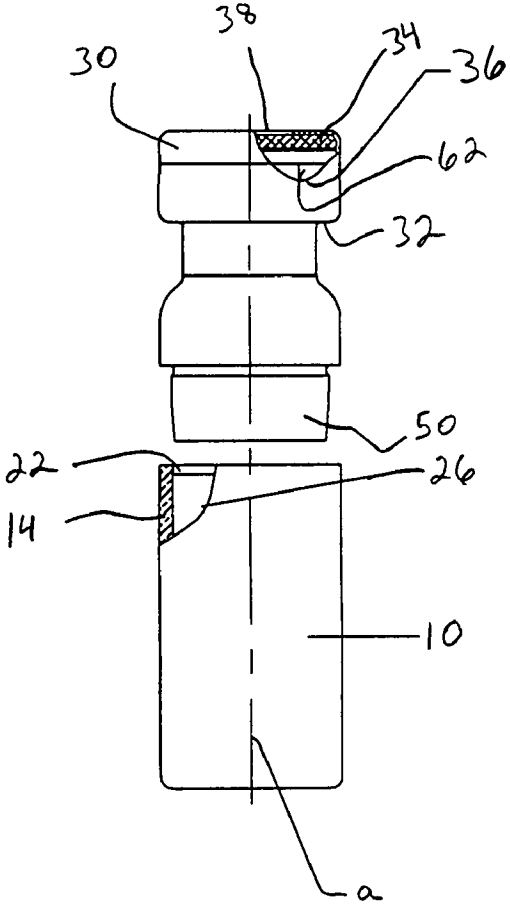
FIG. 5A is a side view of a two piece seal vial assembly, according to an embodiment of the present invention, with the two components in an unassembled state and with a crimp cap in place on the seal top.

FIG. 5A is a side view of the assembly 100, according to an embodiment of the present invention, with the vial 10 and seal top 50 in an unassembled state and with a crimp cap 30 in place on the seal top 50. A cut-away section 26 is provided in the vial 10 and a cut-away section 36 is provided in the crimp cap 30—both to better illustrate the components. The components are aligned along a center line "a." FIG. 5B is a side view of the assembly 100 shown in FIG. 5A with the components in an assembled state. FIG. 5C is an isometric view of the assembly 100 shown in FIG. 5B.

The crimp cap 30 is composed of aluminum, for example, and is used to seal the seal top 50 by securing the lower end 32, as shown in FIGS. 5A and 5B, under the neck finish of the top portion 62 of the seal top 50. The crimp cap 30 has the capacity to retain within itself a liner 34 which may be composed of silicone rubber, butyl rubber, natural rubber or the like. Thus, the liner 34 is resilient and underlies the crimp cap 30. It is possible to access the contents of the vial 10 without removal of the crimp cap 30 by, for example, inserting a syringe into a center hole 38 in the crimp cap 30 and through the perforatable liner 34. The center hole 38 is sufficiently wide (on the order of 0.2 inches) to allow a syringe to be inserted without bending or breaking.

2. Snap Cap

Figure 6C:
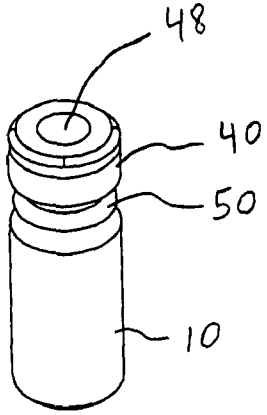
FIG. 6C is an isometric view of the assembly shown in FIG. 6B.
Figure 6B:
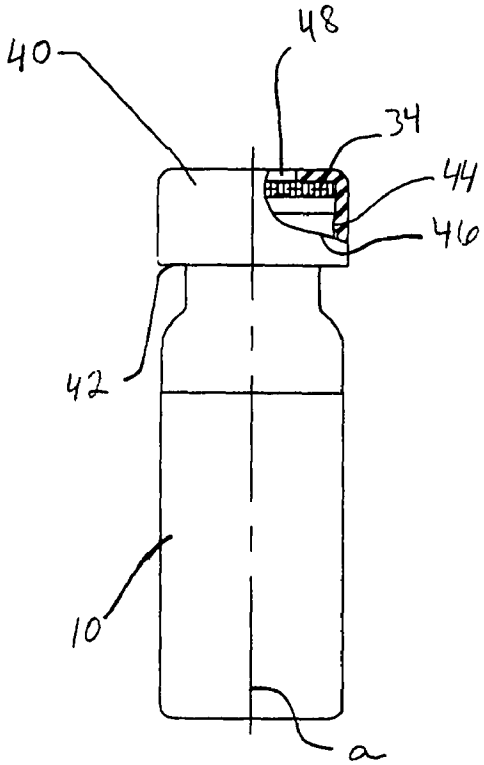
FIG. 6B is a side view of the assembly shown in FIG. 6A with the components in an assembled state.
Figure 6A:
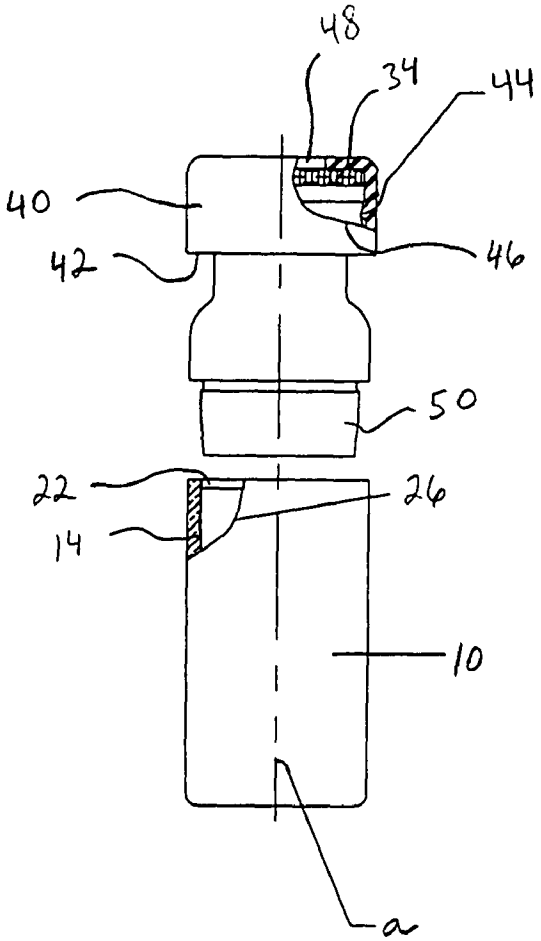
FIG. 6A is a side view of a two piece seal vial assembly, according to an embodiment of the present invention, with the two components in an unassembled state and with a snap cap in place on the seal top.

FIG. 6A is a side view of the assembly 100, according to an embodiment of the present invention, with the vial 10 and seal top 50 in an unassembled state and with a snap cap 40 in place on the seal top 50. A cut-away section 26 is provided in the vial 10 and a cut-away section 46 is provided in the snap cap 40—both to better illustrate the components. The components are aligned along a center line "a." FIG. 6B is a side view of the assembly 100 shown in FIG. 6A with the components in an assembled state. FIG. 6C is an isometric view of the assembly 100 shown in FIG. 6B.

The internal diameter of the snap cap 40 corresponds to or is only slightly greater than the outer diameter of the neck finish of the seal top 50. The snap cap 40 extends vertically (axially) downward from its top to a cap lower end 42, to be substantially flush laterally with the bottom of a lower flange of the top portion 62 of the seal top 50. This configuration facilitates alignment of the snap cap 40 and the seal top 50 as they are assembled.

Four angular locking ribs 44 project from the inner circumference of the snap cap 40 and are located at circumferentially spaced locations around the inside of the snap cap 40. The locking ribs 44 are placed at an axially intermediate height inside the snap cap 40 to provide, in combination with the top portion 62, alignment between the snap cap 40 and the seal top 50. The angular shape of the locking ribs 44 also allows for tolerance variation of the liner 34, ±0.010 of an inch, thus accommodating thick and thin liners 34. The locking ribs 44 retain the liner 34 and provide the pull down and lock mechanism which seals the seal top 50. Like the crimp cap 30, the snap cap 40 has a center hole 48 allowing a syringe to access liquid in the vial 10 without removing the snap cap 40.

The design of the snap cap 40 assures ease of assembling the snap cap 40 and the seal top 50 and for ease of removing the snap cap 40 from the seal top 50. The snap cap 40 requires the use of downward pressure to apply the snap cap 40 and upward pressure to remove the snap cap 40. Such pressure typically is exerted by the thumb of the user.

3. Threaded Cap

Figure 7C:
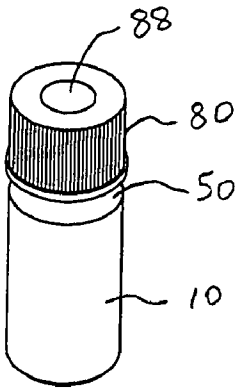
FIG. 7C is an isometric view of the assembly shown in FIG. 7B.
Figure 7B:
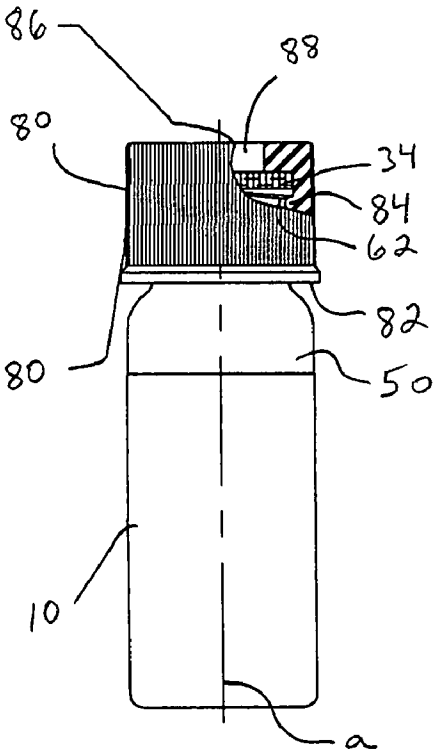
FIG. 7B is a side view of the assembly shown in FIG. 7A with the components in an assembled state.
Figure 7A:
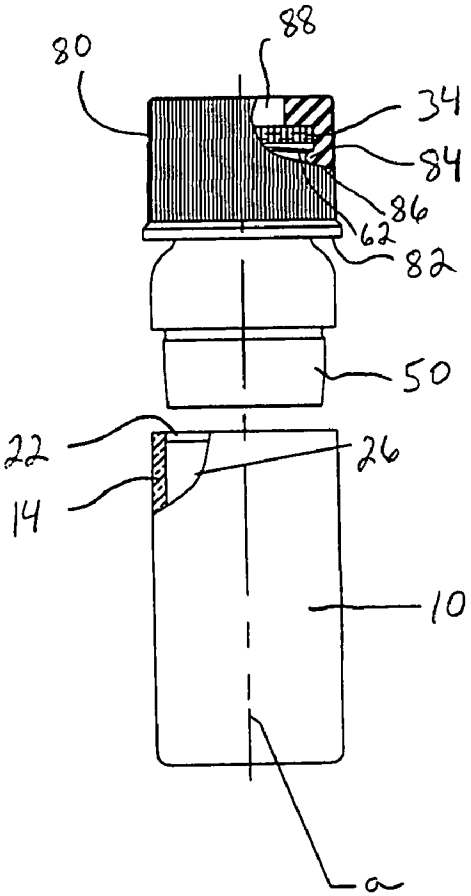
FIG. 7A is a side view of a two piece seal vial assembly, according to an embodiment of the present invention, with the two components in an unassembled state and with a threaded cap in place on the seal top.

FIG. 7A is a side view of the assembly 100, according to an embodiment of the present invention, with the vial 10 and seal top 50 in an unassembled state and with a threaded cap 80 in place on the seal top 50. A cut-away section 26 is provided in the vial 10 and a cut-away section 86 is provided in the threaded cap 80—both to better illustrate the components. The components are aligned along a center line "a." FIG. 7B is a side view of the assembly 100 shown in FIG. 7A with the components in an assembled state. FIG. 7C is an isometric view of the assembly 100 shown in FIG. 7B.

The seal top 50 shown in FIGS. 7A, 7B, and 7C has a standard screw thread neck finish. The threads of the seal top 50 form a clockwise helix around the top portion 62 of the seal top 50. The threaded cap 80 has corresponding threads 84 around its inner circumference to sealingly engage the screw thread neck finish of the seal top 50. The internal diameter of the threaded cap 80 corresponds to or is only slightly greater than the outer diameter of the neck finish of the seal top 50. The threaded cap 80 extends vertically (axially) downward from its top to a cap lower end 82, to be substantially flush laterally with the bottom of a lower flange of the top portion 62 of the seal top 50. This configuration facilitates alignment of the snap cap 40 and the seal top 50 as they are assembled.

The liner 34 may be located in the threaded cap 80 just above the upper-most thread 84. The threaded engagement between the threaded cap 80 and the seal top 50 retains the liner 34 and provides the pull down and lock mechanism which seals the seal top 50. Like the crimp cap 30 and the snap cap 40, the threaded cap 80 has a center hole 88 allowing a syringe to access liquid in the vial 10 without removing the threaded cap 80.

The design of the threaded cap 80 assures ease of assembling the threaded cap 80 and the seal top 50 and ease of removing the threaded cap 80 from the seal top 50. The threaded cap 80 requires a twist or rotational motion to apply the threaded cap 80 and a reverse twist or rotational motion to remove the threaded cap 80. Such movements typically are applied by the thumb and index fingers of the user.

4. Limited Volume Vial Configuration

Particularly when used to retain laboratory or hospital samples involving small fluid samples, the vial 10 may have a limited volume configuration (which, in some cases, may include a separate insert). The vial 100 secures the sample within a limited volume, which facilitates handling and withdrawal of small fluid samples. If a separate insert is provided, a spring often fits between the bottom of the insert and the base 12 of the vial 100 to urge the insert upwardly against a closure cap and against the downward pressure of a fluid-withdrawing instrument. The insert is typically a conical-bottomed inner container, from which fluid sample is withdrawn by a hypodermic needle, syringe, or miniature pipette. Upward biasing of the insert and the conical shape of the internal volume of the insert permit the fine needle or pipette to be pressed into the very bottom of the insert, without damage, to assure complete withdrawal of fluid sample. U.S. Pat. No. 5,108,386 titled "Spring and Container with Spring Biased Inner Container Insert" and issued to the inventor of the present application, James G. Finneran, discloses an improvement in such containers by which complete withdrawal of fluid sample is better assured.

Figure 8A:
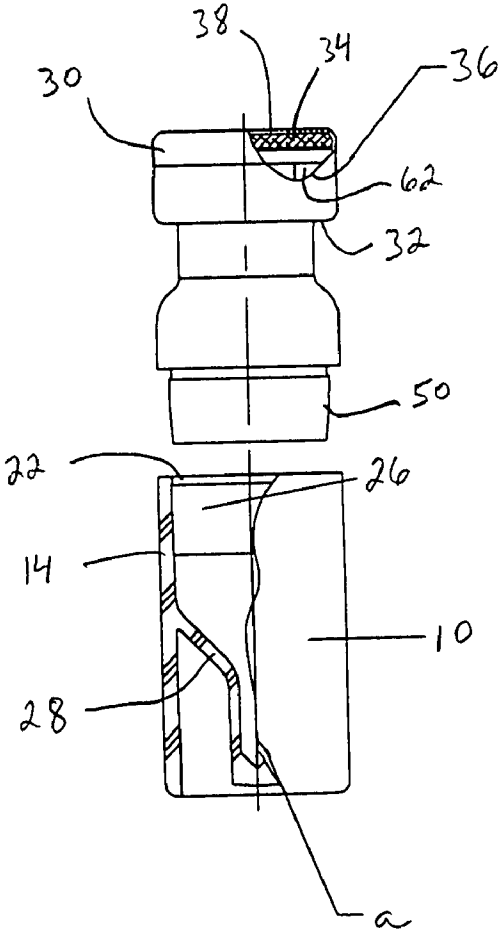
FIG. 8A is a side view of a two piece seal vial assembly, according to an embodiment of the present invention, with the two components in an unassembled state, with a crimp cap in place on the seal top, and with the vial component having a limited volume configuration.
Figure 8B:
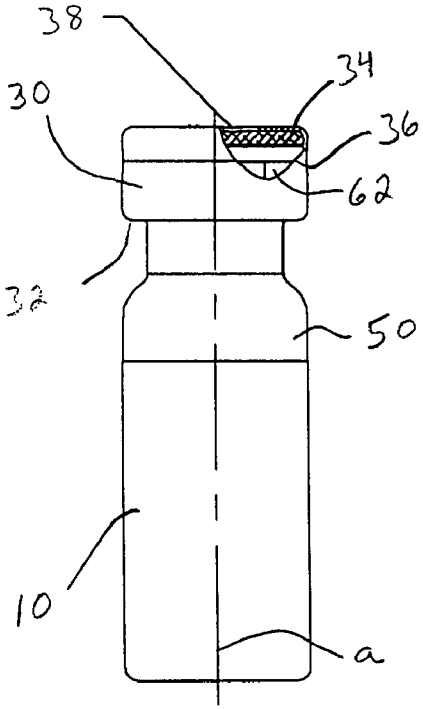
FIG. 8B is a side view of the assembly shown in FIG. 8A with the components in an assembled state.
Figure 8C:
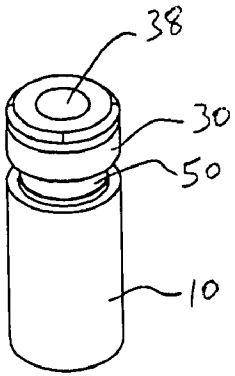
FIG. 8C is an isometric view of the assembly shown in FIG. 8B.

FIG. 8A is a side view of the assembly 100, according to an embodiment of the present invention, with the vial 10 and seal top 50 in an unassembled state and with a crimp cap 30 in place on the seal top 50. FIG. 8B is a side view of the assembly 100 shown in FIG. 8A with the components in an assembled state. FIG. 8C is an isometric view of the assembly 100 shown in FIG. 8B. The assembly 100 shown in FIGS. 8A, 8B, and 8C is identical to the embodiment illustrated in FIGS. 5A, 5B, and 5C except that the vial 10 has a limited volume configuration. Specifically, the side wall 14 of the vial 10 has an integral limited volume section 28 (i.e., the volume section 28 is formed as part of, and is one piece with, the whole side wall 14). The limited volume section 28 has a conical bottom, from which small fluid sample can be withdrawn by a hypodermic needle, syringe, or miniature pipette.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed:

1. A seal vial assembly comprising:

a vial being formed of a resilient and rigid plastic material and defining a center aperture adapted to contain a liquid and having:

(a) a base, (b) a crown disposed opposite the base, and (c) an upright side wall extending from the base to the crown and having a tapered inner diameter and a flange located proximate the crown, the tapered inner diameter having a maximum inner diameter proximate the flange and decreasing gradually toward the base;

a seal top being formed of a resilient and rigid plastic material and defining a center opening that runs through the length of the seal top and having:

(a) a top portion providing a neck finish, (b) a snap groove releasably receiving the flange of the vial when the seal top and the vial are fully assembled, and (c) a tapered portion below the snap groove with an outside diameter greater than the maximum inner diameter of the tapered inner diameter of the vial so that the tapered portion frictionally engages and creates an interference fit with the tapered inner diameter of the vial when the seal top and the vial are assembled; and a cap releasably engaging the neck finish of the seal top to close the seal top.

2. The assembly according to claim 1 wherein the tapered inner diameter of the side wall of the vial and the tapered portion of the seal top are each tapered in the same direction, creating an interference fit between them when the seal top and the vial are assembled.

3. The assembly according to claim 1 wherein the snap groove has a substantially semi-circular cross-section and the flange has a curve corresponding to the cross-section.

4. The assembly according to claim 1 wherein the seal top has, between the top portion and the snap groove, a shoulder with an undercut.

5. The assembly according to claim 4 wherein the snap groove is positioned on the seal top just below the undercut so that the snap groove and the flange of the vial fully engage, during assembly of the seal top and the vial, just before or just as the crown of the vial contacts the undercut of the seal top.

6. The assembly according to claim 1 wherein the cap is selected from the group consisting of crimp caps, snap caps, and threaded caps.

7. The assembly according to claim 1 wherein the vial and seal top are both made of polypropylene.

8. A seal vial assembly adapted to be closed by a separate cap, the assembly comprising:

a vial being formed of a resilient and rigid plastic material and defining a center aperture adapted to contain a liquid and having:

(a) a base, (b) a crown disposed opposite the base, and (c) an upright side wall extending from the base to the crown and having a tapered inner diameter and a flange located proximate the crown, the tapered inner diameter having a maximum inner diameter proximate the flange and decreasing gradually toward the base; and a seal top being formed of a resilient and rigid plastic material and defining a center opening that runs through the length of the seal top and having:

(a) a top portion providing a neck finish adapted to releasably engage the cap to close the seal top, (b) a shoulder with an undercut located under the top portion, (c) a snap groove located under the undercut and releasably receiving the flange of the vial when the seal top and the vial are fully assembled, the snap groove and the flange being fully engaged, during assembly of the seal top and the vial, just before or just as the crown of the vial contacts the undercut of the seal top, and (d) a tapered portion being located under the snap groove and having an outside diameter greater than the maximum inner diameter of the tapered inner diameter of the vial so that the tapered portion frictionally engages and creates an interference fit with the tapered inner diameter of the vial when the seal top and the vial are assembled.

9. The assembly according to claim 8 wherein the tapered inner diameter of the side wall of the vial and the tapered portion of the seal top are each tapered in the same direction, creating an interference fit between them when the seal top and the vial are assembled.

10. The assembly according to claim 8 wherein the snap groove has a substantially semi-circular cross-section and the flange has a curve corresponding to the cross-section.

11. The assembly according to claim 8 wherein the vial and seal top are both made of polypropylene.

12. A seal vial assembly comprising:

a vial being formed of a resilient and rigid plastic material and defining a center aperture adapted to contain a liquid and having:

(a) a base, (b) a crown disposed opposite the base, and (c) an upright side wall extending from the base to the crown and having a tapered inner diameter and a flange located proximate the crown, the tapered inner diameter having a maximum inner diameter proximate the flange and decreasing gradually toward the base;

a seal top being formed of a resilient and rigid plastic material and defining a center opening that runs through the length of the seal top between a top and a bottom and having:

(a) a top portion proximate the top and including a neck finish, (b) a substantially flat transition portion proximate the top portion, (c) a shoulder with an undercut located proximate the transition portion, (d) a snap groove located proximate the undercut and releasably receiving the flange of the vial when the seal top and the vial are fully assembled, the snap groove and the flange being fully engaged, during assembly of the seal top and the vial, just before or just as the crown of the vial contacts the undercut of the seal top, and (e) a tapered portion being located proximate the snap groove, having an outside diameter greater than the maximum inner diameter of the tapered inner diameter of the vial, and frictionally engaging the tapered inner diameter of the side wall of the vial when the seal top and the vial are assembled, wherein the tapered portion and the tapered inner diameter are each tapered in the same direction creating an interference fit between them when the seal top and the vial are assembled; and a cap releasably engaging the neck finish of the seal top to close the seal top.

13. The assembly according to claim 12 wherein the snap groove has a substantially semi-circular cross-section and the flange has a curve corresponding to the cross-section.

14. The assembly according to claim 12 wherein the cap is selected from the group consisting of crimp caps, snap caps, and threaded caps.

15. The assembly according to claim 12 wherein the vial and seal top are both made of polypropylene.

* * * * *